US005594996A

United States Patent [19]

Haavisto

[11] Patent Number: 5,594,996

[45] Date of Patent: Jan. 21, 1997

[54] APPARATUS FOR DRYING A FIBRE WEB

[75] Inventor: Seppo Haavisto, Hämeenkyrö , Finland

[73] Assignee: Valmet-Tampella Oy, Tampere, Finland

[21] Appl. No.: 283,256

[22] Filed: Aug. 1, 1994

[51] Int. Cl.[6] ..... F26B 13/10

[52] U.S. Cl. ..... 34/66; 34/242; 34/119

[58] Field of Search ..... 34/62, 66, 71, 34/95, 116, 119, 242, 355, 392

[56] References Cited

U.S. PATENT DOCUMENTS

| | | | |
|---|---|---|---|
| 4,112,586 | 9/1978 | Lehtinen | 34/355 |
| 4,461,095 | 7/1984 | Lehtinen | 34/94 |
| 4,506,457 | 3/1985 | Lehtinen | 34/66 |
| 4,622,758 | 11/1986 | Lehtinen et al. | 34/119 |
| 4,787,641 | 11/1988 | Rautakorpi et al. | 34/242 |
| 4,887,362 | 12/1989 | Rautakorpi | 34/66 |
| 4,899,461 | 2/1990 | Lehtinen | 34/392 |
| 4,932,139 | 6/1990 | Lehtinen | 34/69 |
| 4,958,444 | 9/1990 | Rautakorpi et al. | 34/95 |
| 5,471,765 | 12/1995 | Rautakorpi et al. | 34/242 |

*Primary Examiner*—James Larson
*Attorney, Agent, or Firm*—Ladas & Parry

[57] ABSTRACT

A drying apparatus for drying a fibre web (5) between two air-tight bands (1, 2) moving in the same direction. One band (1) is heated by hot steam and the other band (2) is cooled by water, and the fibre web (5) is passed through a drying zone formed by the bands (1, 2) with at least one felt or wire (3, 4) so that the fibre web (5) is in contact with the surface of the heated band, and the felt or wire (3, 4) is between the fibre web (5) and the cooled band (2). In the invention the drying zone and the water chamber (14) cooling the lower band (2) are in communication with each other for controlling the pressure difference between them by a simple connection, such as a pipe (25) opening at a suitable height.

15 Claims, 4 Drawing Sheets

FIG. 1
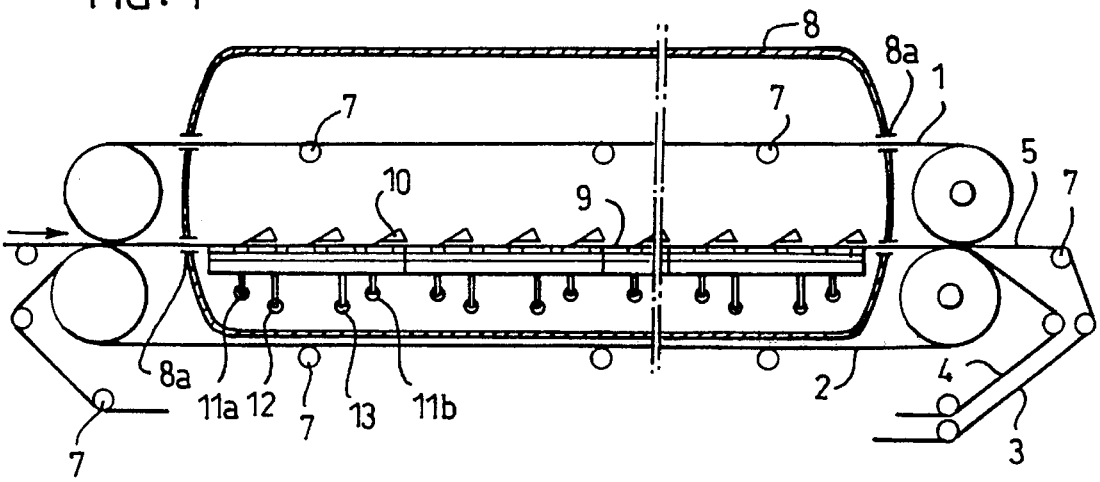
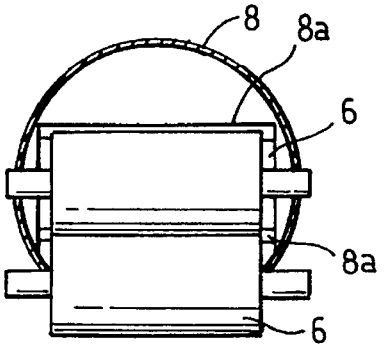
FIG. 2
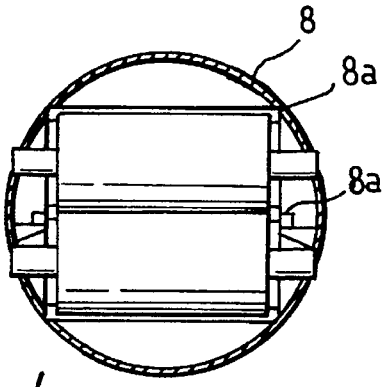
FIG. 4
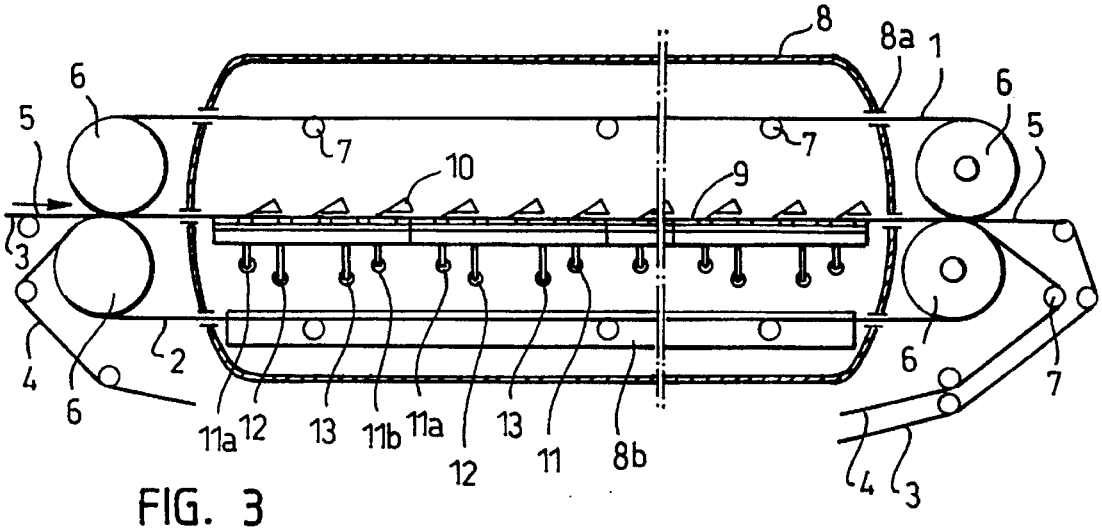
FIG. 3

FIG. 5
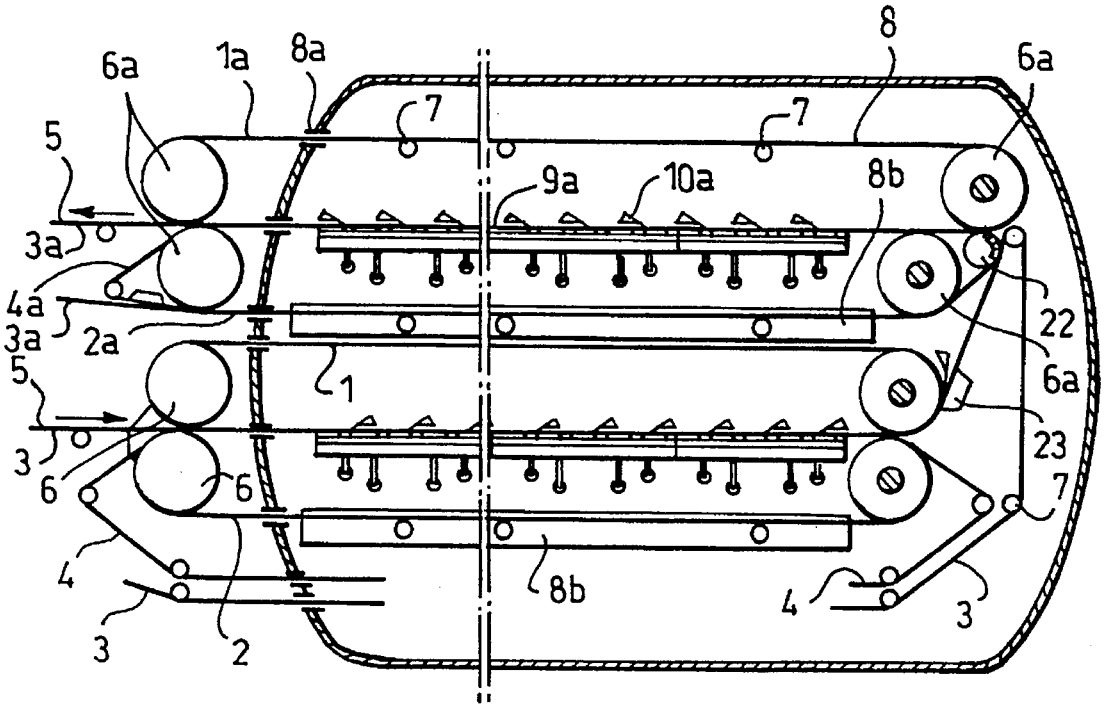
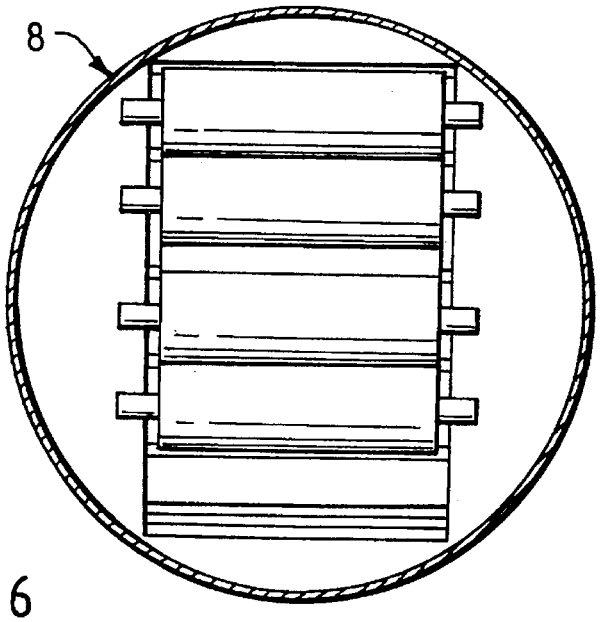
FIG. 6

APPARATUS FOR DRYING A FIBRE WEB

BACKGROUND OF THE INVENTION

The invention relates to a drying apparatus for drying a fibre web, comprising two endless bands impermeable to air and having a good thermal conductivity, said bands being arranged to move in parallel with each other over a distance so that they form therebetween a drying zone where one band is heated by pressurized steam and the other band is cooled by pressurized water or some other efficient heat transfer medium, whereby the fibre web and at least one felt or wire are passed between the bands through the drying zone formed by the bands so that the fibre web is in contact with the heated band while the felt or wire is positioned between the fibre web and the cooled band.

It is known from e.g. Finnish Patents 66041, 76192 and 76856 to dry a fibre web between two parallel metal bands moving in the same direction so that the fibre web is in contact with a heated metal band and a felt is arranged between the fibre web and the other i.e. cooled metal band such that steam separating from the fibre web as a result of heating will condense in the felt under the influence of the cold metal band. The operation is based on two endless metal bands arranged to move around turning rolls and a pressure chamber formed against a surface remaining inside each one of the two loops formed by the metal bands. One pressure chamber contains hot steam while the other contains water so that pressure created presses the hot and the cold band and thus the fibre web and the felt positioned therebetween against each other. The bands, which are positioned between the pressure chambers, form one side in the pressure chambers by means of seals so that steam and water are able to act directly on the bands. The operation of the apparatus as such is fully known and has been described e.g. in the above-mentioned patents, which are incorporated herein by reference.

The problem with the prior art solutions is that especially the steam chamber is difficult to seal, as a result of which steam escapes from the chamber between its edge and the heated band on the side of the chamber, thus causing noise problems and other problems. What is even more important, it causes great temperature differences at the band edge, as steam condensing to a low pressure cools the band edges with resultant thermal stresses and bending or cracking of the edges, which is disadvantageous to the operation of the apparatus and may cause serious damage.

In an attempt to avoid such a problem, various sealing arrangements and other solutions have been used, which, however, often complicate the structure and make it difficult to realize.

SUMMARY OF THE INVENTION

The object of the present invention is to provide a drying apparatus which avoids the above disadvantages and is so constructed that it is easy to realize and the whole operation of which can be controlled easily. The drying apparatus according to the invention is characterized in that the steam pressure prevailing in the steam chamber and the water pressure prevailing in the water chamber are arranged to be substantially equal by a connection extending from the water chamber to the steam chamber.

The pressure chamber can be cylindrical in shape and enclose most of the linearly moving portions of the upper band and the lower band portion in contact with the felt as well as the water pressure chamber used for cooling the lower band. An alternative embodiment is to form the steam pressure chamber into a closed structure integral with the water pressure chamber, whereby the water pressure cheer forms part of the entire pressure chamber. The pressure chamber may also be box-like, in which case the return travel of the metal bands is preferably arranged to take place outside the box.

BRIEF DESCRIPTION OF THE DRAWINGS

The invention will be described more closely with reference to the attached drawings, in which FIG. 1 is a schematic side view of one embodiment of the drying apparatus according to the invention in a section made in the direction of travel of the web;

FIG. 2 shows the drying apparatus shown in FIG. 1 as seen from the web inlet end;

FIG. 3 a side view of another embodiment of the drying apparatus according to the invention in a section made in the direction of travel of the web;

FIG. 4 shows the embodiment of the drying apparatus shown in FIG. 3 from the web inlet end;

FIG. 5 is a side view of still another embodiment of the drying apparatus according to the invention in a section made in the direction of travel of the web;

FIG. 6 shows the embodiment of the drying apparatus shown in FIG. 5 as seen from the web inlet end;

DESCRIPTION OF PREFERRED EMBODIMENTS

Figure 7:
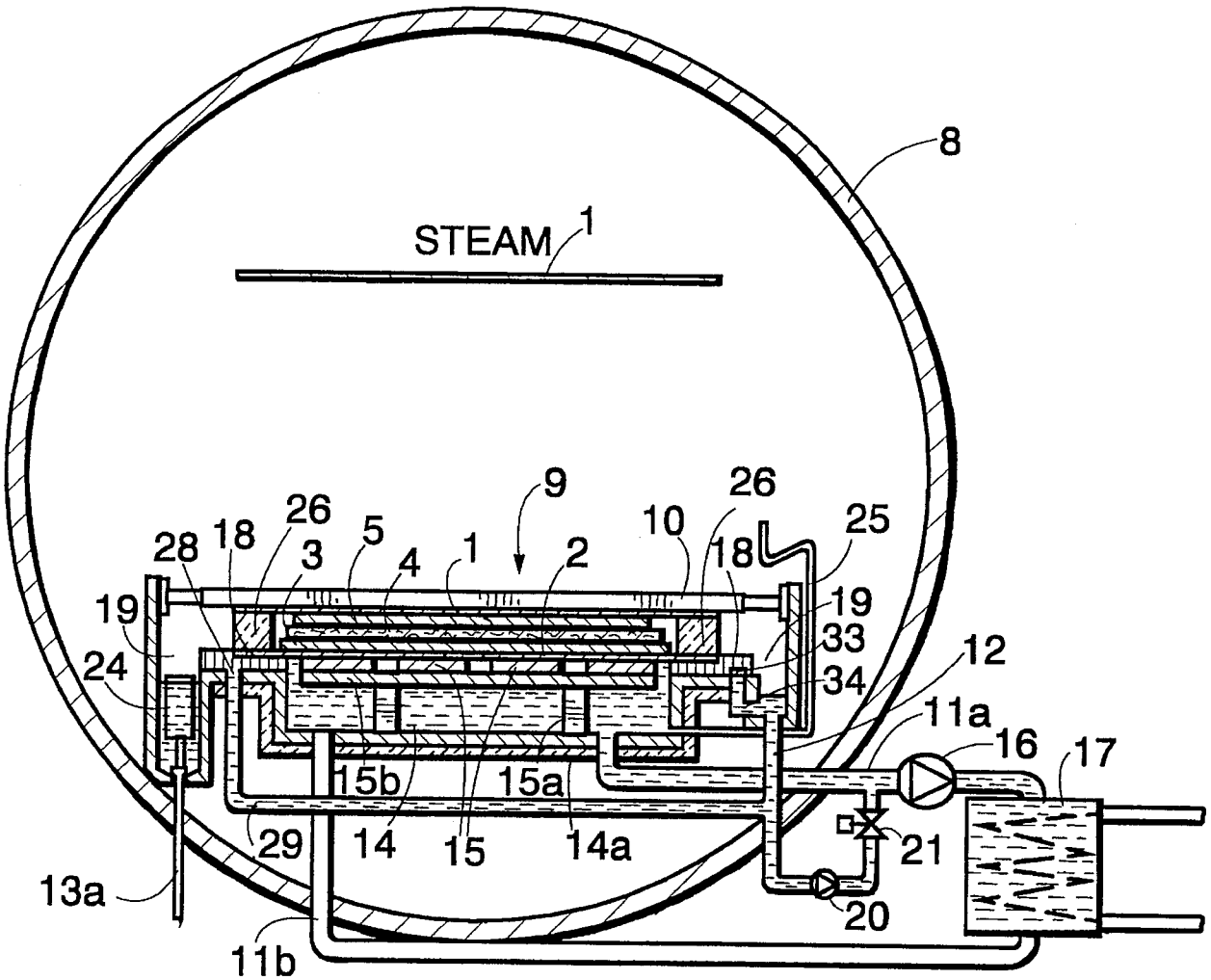
FIG. 7 is a more detailed cross-sectional view of the embodiment of the drying apparatus according to the invention shown in FIG. 1.

FIG. 1 is schematic side view of the drying apparatus according to the invention in a section made in the direction of travel of the web. The drying apparatus comprises an endless upper band 1 and an endless lower band 2, which are impermeable to air and have a good thermal conductivity, being preferably made of metal. A fine wire 3, a coarse wire 4 and a fibre web 5 move on between the band surfaces facing each other. The upper band 1 and the lower band 2 turn around band rolls 6 positioned at the ends of the drying apparatus. The wires 3 and 4 are supported and guided by guide rolls 7. For the steam heating required by the drying process, the drying apparatus comprises a pressure cheer 8. A drying zone extends along a so-called water table 9 within the pressure chamber 8 between the parallel portions of the upper band 1 and lower band 2. Above the water table 9, doctor blades 10 for removing condensate are positioned against the upper band 1. Circulating water pipes 11*a* and 11*b*, pressurizing pipes 12 and condensate return pipes 13 are positioned below the water table 9. In the figure, only one set of pipes has been indicated by reference numerals, but the other sets of pipes have a similar function. Connection and operation of the pipes and the structure of the water table will be described in more detail with reference to FIG. 7.

The operation of the drying apparatus is based on heating the upper band 1 in contact with the web 5 by hot steam contained in the pressure chamber 8, whereby water contained in the web 5 evaporates due to the high temperature of the upper band 1 and passes through the wires 3 and 4 towards the lower band 2. The lower band 2 in turn is cooled continuously by water arranged below it, whereby steam reaching the surface of the band will condense into water and is removed with the wires 3 and 4. Correspondingly, as the evaporation of the water contained in the web cools the upper band positioned against the web, steam will condense into water on to the other surface of the band 1. The condensation water is removed by the doctor blades 10 so that heat transfer from the steam into the band 1 could take place as efficiently as possible. As the actual drying zone, i.e. a portion of the bands 1 and 2 equal in length to the water table 9, is surrounded by the pressure chamber 8, the upper band 1 need not be sealed relative to the steam chamber, as has been done in the prior art solutions. Accordingly, the only measures required in the drying apparatus are to arrange the flows of cooling water and the flows of condensation water around the water table 9 and to seal the bands 1 and 2 by seals 8*a* relative to the pressure chamber 8 so that the steam pressure can be maintained at a suitable level.

FIG. 2 shows the drying apparatus shown in FIG. 1 from the end in the direction of entry of the web. It appears from the figure how the rolls 6 are positioned relative to the pressure chamber 8 and how the seals 8*a* extend over the width of the bands 1 and 2 at the end of the pressure chamber 8.

FIGS. 3 and 4 show the drying apparatus according to the invention in the same way as in FIG. 1 and 2. The same reference numerals are used for the corresponding parts. In the solution of FIGS. 3 and 4, however, the lower band 2 is arranged to return through the pressure chamber 8, being thus protected against the heating effect of steam by a separate protective housing 8*b*.

FIGS. 5 and 6 show a third embodiment of the drying apparatus according to the invention, where the web passes into the pressure chamber 8 and out of the pressure chamber at the same end. Two drying steps have thus been constructed one upon the other within the pressure chamber 8, whereby the two drying steps comprise substantially the same parts. As shown in FIG. 5, the web 5 enters the pressure chamber at the bottom, from the left in the figure, between the rolls 6 and so do the wires 3 and 4. The band rolls 6 at the opposite end of the upper band and the lower band 2 are mounted inside the pressure chamber 8 and so are the guide rolls 7 for the wires 3 and 4. Correspondingly, the return travel of the lower band 2 takes place through the protective housing 8*b* so that the heating effect of steam is as small as possible.

After the drying zone, the web 5 and the fine wire 3 are passed upwards, and a suction box 23 is positioned against the wire 3 so as to detach the web 5 from the band 1. A doctor blade and a blower can be employed to ensure successful transfer. Within the pressure chamber, band rolls 6*a* for the bands of the upper drying step are mounted one after the other in the longitudinal direction of the pressure chamber 8 so that wires 3*a* and 4*a*, or wire 3*a* alone, in the upper drying zone can move around a separate suction roll 22, whereby the web 5 is loosened from the wire 3 and transferred between bands 1*a* and 2*a* of the upper zone onto a second water table 9*a*. The web 5 then moves together with the wires 3*a* and 4*a* through the water table 9*a*, whereby one side of the web 5 is positioned against the heated upper band la and the opposite side, which was heated in the preceding drying step, is positioned against the water-cooled lower band 2*a*. In this case, the returning portion of both of the cooled bands 2 and 2*a* is arranged to pass through its own protective housing 8*b* separate from the steam space to reduce the warming up of the band. A similar arrangement may be provided for the wires 3, 3*a*, 4 and 4*a*.

FIG. 6 correspondingly shows the drying apparatus shown in FIG. 5 from the inlet and outlet end of the bands.

FIG. 7 is a more detailed cross-sectional view of the drying apparatus shown in FIG. 1. A water chamber 14 is provided in the water table 9 below the lower band 2. Water contained in the water chamber cools the band 2. Further, supporting laths 15 are provided below the band 2 for supporting it from below. The supporting laths 15, preferably formed by a number of successive lath portions, may be secured, as shown in the figure, by support feet 15*a* and a support plate 15*b* to the bottom of the water chamber 14, or they may be attached to the body of the water chamber 14 in some other way. Water contained in the water chamber circulates under the influence of a circulating pump 16 through the circulating water pipes 11*a* into a heat exchanger 17, where it is cooled. The water then returns through the circulating water pipes 11*b* into the water chamber 14, whereby the band 2 cools under the influence of the cooled water. The lower band 2 is sealed relative to the edges of the water chamber 14 by brush seals 18 formed by brush-like upwardly extending seal members. The band 2 slides along the surface of these seals, and so water is able to flow slowly through the seals 18 into a water collecting chute 19 positioned outside the water chamber 14 to its both sides. Similarly, condensation water removed from the upper band 1 by the doctor blades 10 is discharged into the water collecting chutes 19, from which water is sucked through the pressurizing pipes 12 by a pressurizing pump 20 and further through a regulating valve 21 into the circulating water pipe 11*a*. As the steam introduced into the pressure chamber 8 condenses, and the formation of condensation water increases the amount of water contained in the space, one or more floats 24 are provided in the side chamber 19 for adjusting the flow of water into a condensate removal pipe 13*a*. Accordingly, increase in the amount of water is compensated for by water discharged through the condensate removal pipe 13*a*. The water chamber 14 is protected from below against the heating effect of steam by an insulation 14*a*. The water chamber 14 further comprises a pressure connection 25 formed by a pipe extending above the water table 9 and communicating with the water chamber 14. The pressure of the steam is thus able to act through the pressure connection 25 on the water chamber 14, thus making the forces pressing the bands 1 and 2 against each other substantially equal. Edge seals 26 are provided separately between the bands 1 and 2 at the edges thereof. The edge seals prevent steam from entering between the bands 1 and 2, whereby the saturation of the web and the wires with pressurized steam can be avoided.

Figure 8:
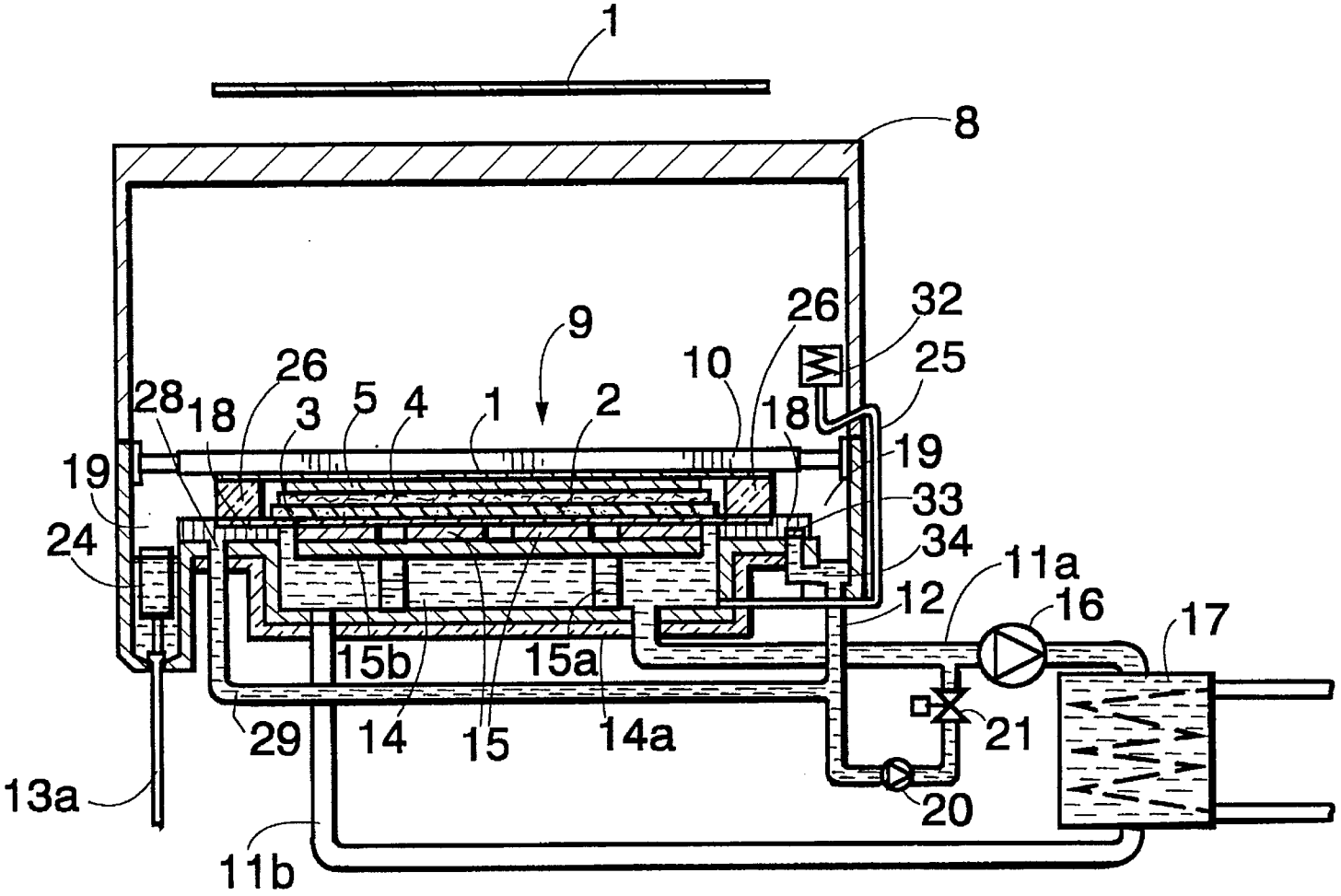
FIG. 8 a schematic cross-sectional view of still another embodiment of the drying apparatus according to the invention.

FIG. 8 further shows another way of sealing the edges of the bands 1 and 2 and the wires 3 and 4. In this case, the upper surface of the seal 18 is provided with a central groove 28 extending over the whole length of the edge, and channels 29 lead from the groove to the pressurizing pump 20. When water enters from the water chamber 14 between the band 2 and the edge of the water chamber 14, at least a part of it is recycled through the pressurizing pump 20 and a part possibly flows over the edge into the water collecting chute 19. In other respects, the operation of this alternative is similar to the solution described above with reference to FIG. 7. In this version condensation water removed from the heated band 1 and water escaped from the water chamber can be collected separately, whereby the heat content of the condensation water can be recovered more efficiently. It is also possible to recycle hot condensation water by a separate outer groove 33 and a separate channel 34.

FIG. 8 shows still another embodiment of the drying apparatus according to the invention in a transverse sectional view. This embodiment corresponds to the embodiment shown in FIG. 7 in structure and operation with the exception that the pressure chamber 8 is box-like, and the water chamber forms part of the pressure chamber structure. The reference numerals used in FIG. 8 correspond to those used in FIG. 7 and the operation of the parts is also similar except that the solution further comprises an inlet (not shown) with a non-return valve (not shown). As it is possible in certain operating conditions that the bands 1 and 2 and the wires 3 and 4 positioned between the bands bring water along with them between the seals of the pressure chamber 8 on leaving the drying zones at their ends, it may be necessary to add water to the water chamber 14 and its cooling water circulation to compensate for the water wasted. This may be done through the water inlet 30 and the non-return valve 31. FIG. 8 further shows a valve 32, groove 33 in seal 18 for collecting hot condensation water, and return channel 34 for hot condensation water.

The invention has been described above and shown in the drawings only by way of example, and it is not in any way restricted to these examples. Combinations of the different examples differing from those disclosed also fall within the scope of the invention. The two-storey drying apparatus shown in FIGS. 5 and 6 may be replaced with a multi-storey solution. In a three-storey solution, for instance, the fibre web can be introduced into the drying apparatus through its one end and removed through its other end.

I claim:

1. Drying apparatus for drying a fibre web, comprising two endless bands impermeable to air and having a good thermal conductivity, said bands being arranged to move in parallel with each other over a distance so that they form therebetween a drying zone where one band is heated by pressurized steam contacting a surface of the one, heated band opposite the drying zone from a steam chamber and the other band is cooled by a pressurized fluid heat transfer medium contacting an opposite surface of the other, cooled band from a heat-transfer-medium chamber the fibre web and at least one felt or wire are passed between the bands through the drying zone so that the fibre web is in contact with the heated band while the felt or wire is positioned between the fibre web and the cooled band, the steam pressure prevailing in the steam chamber and the heat transfer medium pressure prevailing in the heat-transfer-medium chamber being arranged to be substantially equal by a connection extending from the heat-transfer-medium chamber to the steam chamber.

2. Drying apparatus according to claim 1, wherein the connection is a pipe.

3. Drying apparatus according to claim 1, wherein the heat transfer medium in the heat-transfer-medium chamber is arranged to circulate through a cooling device for keeping it at a suitable temperature.

4. Drying apparatus according to claim 1, wherein band rolls for the bands are mounted outside the steam chamber, and the bands are arranged to pass through at least one wall of the steam chamber at seals therefor.

5. Drying apparatus according to claim 1, wherein seals are provided at edges of the bands so as to separate the drying zone from the steam chamber.

6. Drying apparatus according to claim 1, wherein seals are provided on sides of the heat-transfer-medium chamber under edges of the bands for preventing flow of the heat transfer medium into the steam chamber.

7. Drying apparatus according to claim 6, wherein the seals are brush seals.

8. Drying apparatus according to claim 6, wherein the seals have suction openings for gathering condensation water into a cooling circulation.

9. Drying apparatus according to claim 6, wherein the seals have suction openings through which condensation water is recycled.

10. Drying apparatus according to claim 1, wherein the heat transfer medium is water and collecting chutes are provided on the sides of the heat-transfer-medium chamber for collecting water escaping from the heat-transfer-medium chamber.

11. Drying apparatus according to claim 10, wherein the water in the collecting chutes is passed through a pump into a water circulation of the heat-transfer-medium chamber.

12. Drying apparatus according to claim 10, wherein a surface level adjuster is installed in at least one of the collecting chutes for adjusting the level of the water in the collecting chute.

13. Drying apparatus according to claim 1, wherein at least one doctor blade is mounted against the surface of the heated band for the removal of water condensed on the surface into collecting chutes.

14. Drying apparatus according to claim 1, wherein one of the bands is lower than the other of the bands and further comprising supporting laths below the lower one of the bands for supporting the lower one of the bands from below.

15. Drying apparatus according to claim 1, wherein the heat-transfer-medium chamber is in the steam chamber so that the steam chamber extends from an edge of the heat-transfer-medium chamber around the drying zone.

* * * * *